United States Patent [19]

Crites

[11] Patent Number: 4,757,651

[45] Date of Patent: Jul. 19, 1988

[54] WALL SYSTEM

[75] Inventor: Michael K. Crites, Elida, Ohio

[73] Assignee: Crites Enterprises, Inc., Elida, Ohio

[21] Appl. No.: 77,650

[22] Filed: Jul. 24, 1987

[51] Int. Cl.[4] ..... E04B 1/70; E04F 17/00

[52] U.S. Cl. ..... 52/169.5; 137/362; 52/293; 52/299

[58] Field of Search ..... 52/127.2, 749, 742, 52/169.5, 169.8, 698, 225, 60, 61, 299, 293; 137/362

[56] References Cited

U.S. PATENT DOCUMENTS

| | | | |
|---|---|---|---|
| 3,147,570 | 9/1964 | Shanton | 52/169.8 |
| 3,304,672 | 2/1967 | Bakke | 52/169.5 |
| 3,537,220 | 11/1970 | Ellis | 52/698 |
| 3,850,193 | 11/1974 | Guzzo | 52/169.5 |
| 4,068,427 | 1/1978 | Camardo | 52/749 |
| 4,075,800 | 2/1978 | Molick | 52/169.5 |

*Primary Examiner*—John E. Murtagh

*Attorney, Agent, or Firm*—Emch, Schaffer, Schaub & Porcello Co.

[57] ABSTRACT

A wall system for use on a vertical wall, such as a basement wall, is disclosed. A drain conduit is positioned adjacent the wall footer and a collection member is mounted along the bottom of the wall. A plurality of connector conduits extend between the collection member and the drain conduit. In one embodiment a vertical support column is mounted adjacent the wall.

8 Claims, 4 Drawing Sheets

WALL SYSTEM

BACKGROUND OF THE INVENTION

The present invention is directed to a wall system for removing water from a vertical wall and for supporting the wall.

Systems for removing water from walls, such as basement walls, have been proposed in the past. One such wall system is disclosed in U.S. Pat. No. 3,287,866 granted Nov. 29, 1966. In this prior art system the lowermost portion of the wall is cut away and the water drained through a gravel layer to a drain title. A major defect of this prior art system is that the drain tile is positioned below the basement floor and there is no positive connection between the basement wall and the drain tile.

SUMMARY OF THE INVENTION

The present invention is directed to a wall system for use on a vertical wall such as a basement wall which extends upwardly from a footer. The wall system includes a drain conduit which is positioned adjacent the footer and extends generally parallel to the wall. A collection member defining a water collection chamber is mounted on the wall adjacent the footer. A plurality of connector conduits are spaced along the wall and extend between the collection member and the drain conduit to provide a direct connection in removing water from the wall; to the collection member; through the connector conduits; and to the drain conduit.

In one embodiment of the invention, at least one vertical column is positioned adjacent the wall to support the wall from, for example, external hydraulic pressure.

DESCRIPTION OF THE PREFERRED EMBODIMENTS

Figure 1:
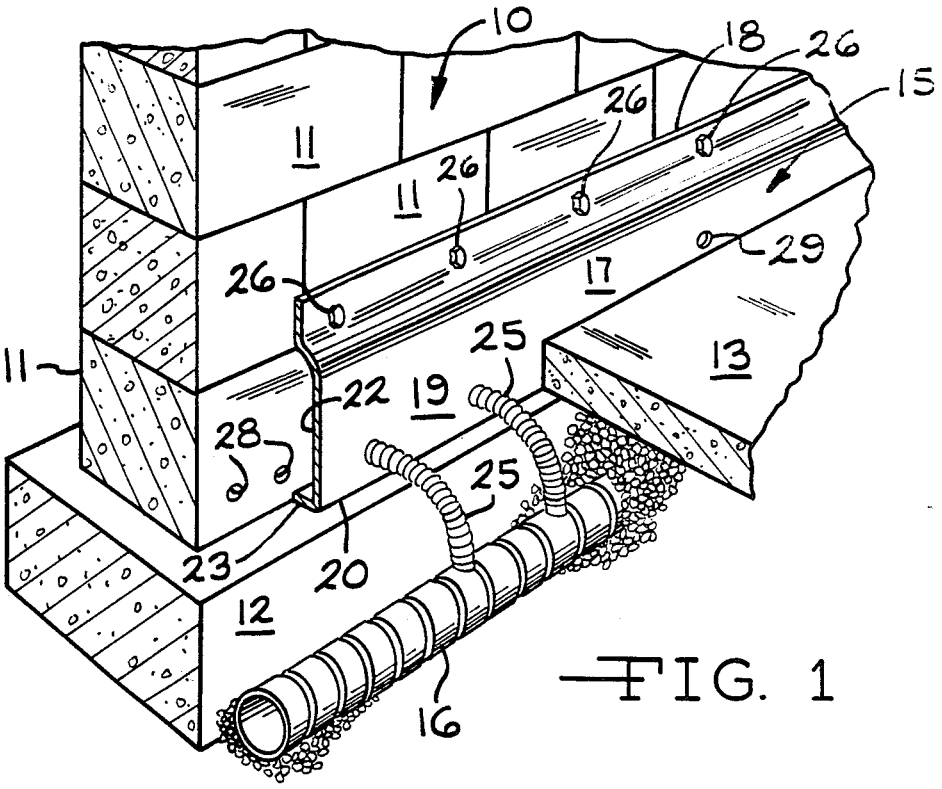
FIG. 1 is a fragmentary, perspective view, partially in section, showing a wall system, according to the present invention.
Figure 2:
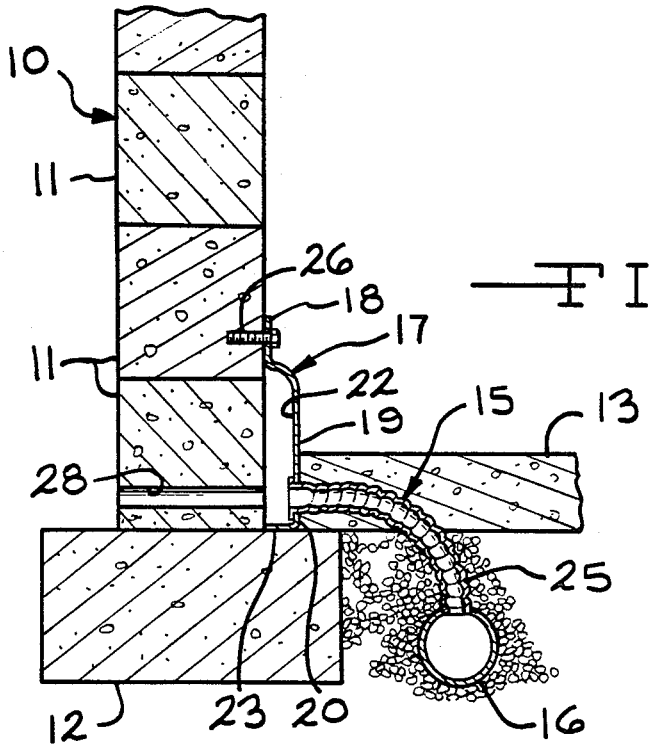
FIG. 2 is a vertical cross section view of the wall system shown in FIG. 1.

Referring to FIG. 1, a vertical, longitudinally extending, wall is generally indicated by the reference number 10. While the wall 10 is depicted in FIGS. 1 and 2 as a solid block wall constructed from individual blocks 11, the blocks may also be hollow blocks as commonly used in basement wall construction. Similarly, the blocks may be made of various materials such as concrete blocks, cinder blocks or wood blocks. In the embodiment shown in FIGS. 1 and 2, the vertical wall 10 is a basement wall and rests upon a concrete footer 12. A concrete floor 13 extends outwardly from the wall 11 over the footer 12.

A wall system, according to the present invention, is generally indicated by the reference number 15. The wall system 15 includes a drain conduit 16 which is positioned adjacent the footer 12 and extends generally parallel to the wall 10. In the present embodiment, the drain conduit 16 is depicted as a continuous length of plastic pipe. Other types of drain conduits may also be utilized including perforated plastic pipe, ceramic tiles and the like. The wall system 15 also includes a longitudinally extending collection member 17, which in the present embodiment comprises a continuous plastic extrusion member. The collection member 17 includes a top portion 18, a body portion 19 and a lower edge portion 20. The body portion 19 is spaced from the vertical wall 10 and defines therewith a water collection chamber 22. In the present embodiment, the lower edge portion 20 includes a turned-in leg 23 which rests on the footer 12 and engages the wall 10. The leg 23 of the lower edge portion 20 of the collection member 17 may be adhered to the top of the footer 12 by the use of hydraulic cement of other waterproof adhesive thereby providing a watersealed chamber defined by the collection member 17 and the vertical wall 10. A plurality of connector conduits 25 extend between the body portion 19 of the collection member 17 and the drain conduit 16. In the present embodiment, the conduits 25 are constructed of plastic drain hose.

A plurality of fasteners 26 extend through the top portion 18 of the collection member 17 and fasten the collection member 17 to the vertical wall 10. A plurality of seep holes 28 are provided in the lower row of blocks 11 of the vertical wall 10. In the embodiment shown in FIGS. 1 and 2, the seep holes 28 extend completely through the blocks 11 to pick up water adjacent the foundation on the outside of the wall 10. In other embodiments the seep holes 28 would only extend into the blocks 11 far enough to reach the hollow chambers within typical masonry blocks used in basement wall construction.

After water enters the water collection chamber 22 of the collection member 17, it is removed through the collector conduits 25 to the drain conduit 16. The drain conduit 16 is normally connected outside of the home to a community sewer system, such as a storm sewer or to some other point of discharge.

A plurality of vent holes 29 are defined by the portion 19 of the collection member 17. The vent holes 29 provide ventilation of the collection chamber 22.

Figure 3:
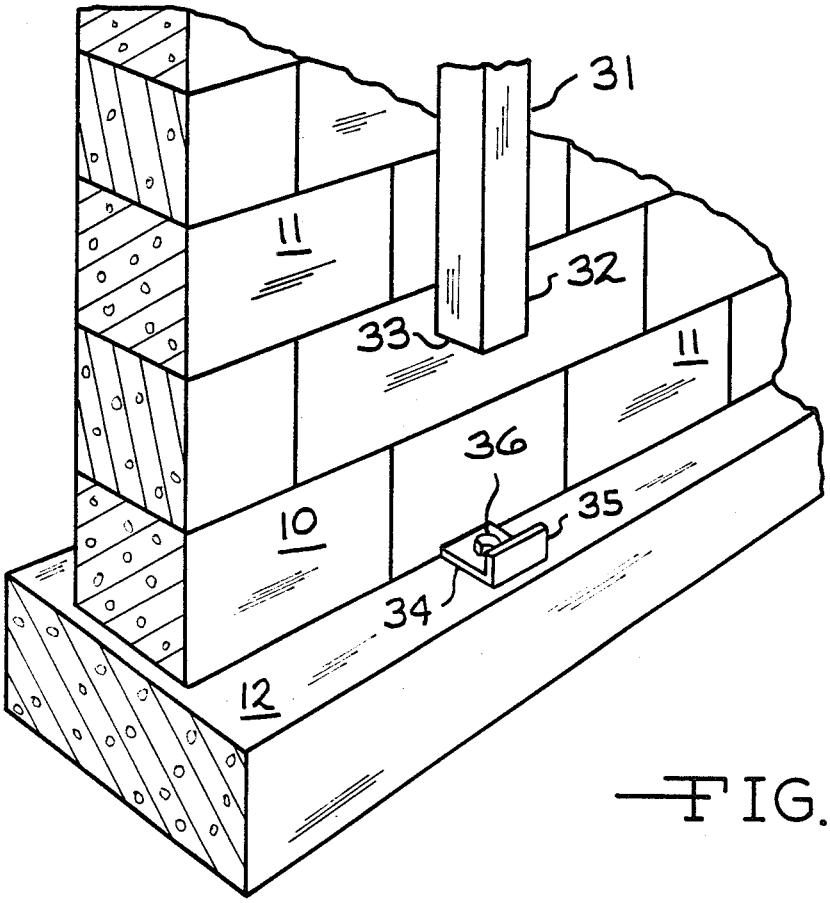
FIG. 3 is a fragmentary, perspective view showing the lower end of a column being moved into position adjacent a wall and footer.
Figure 5:
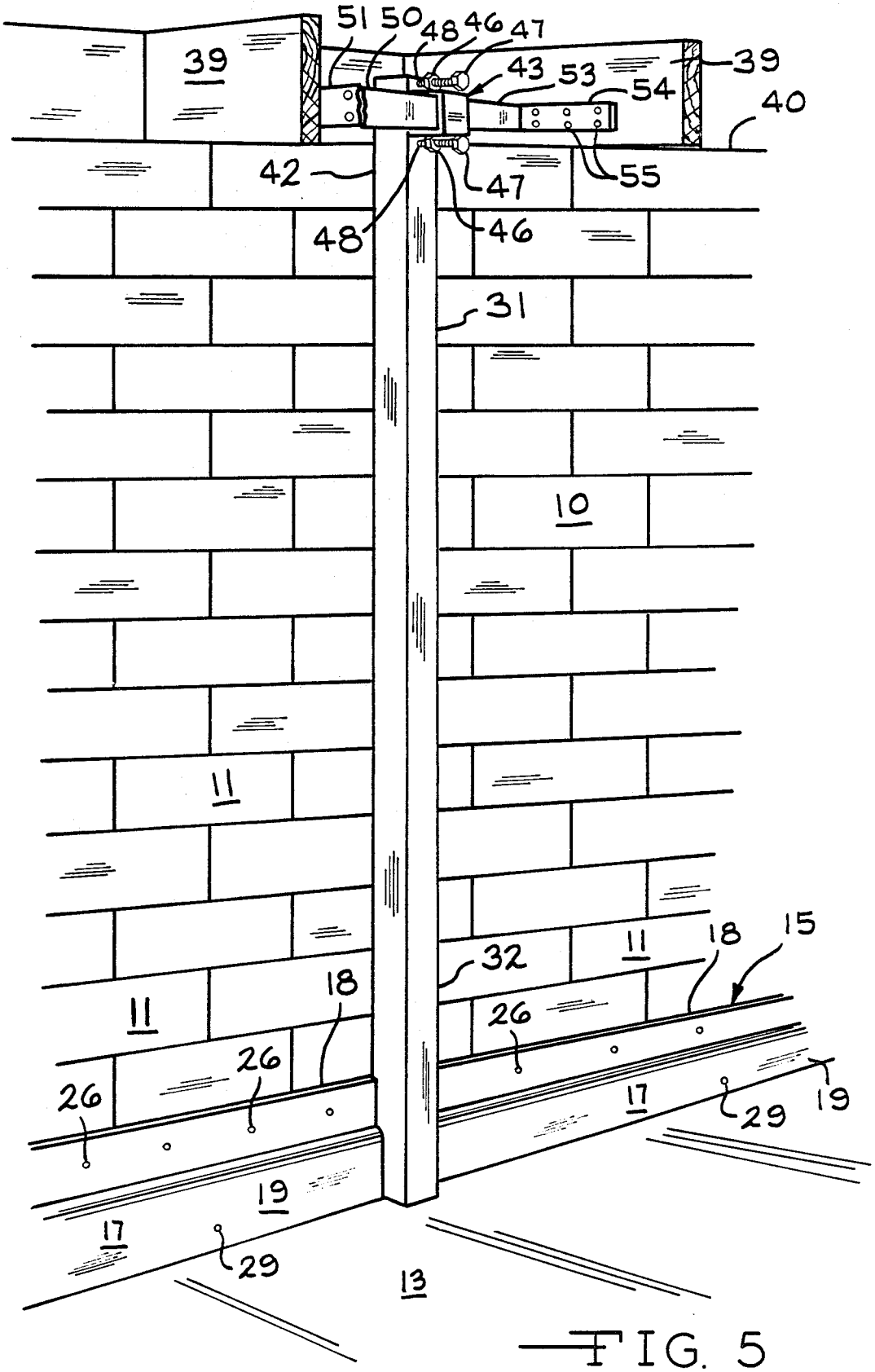
FIG. 5 is a perspective view showing a wall system, according to the present invention including a support column.

Referring to FIG. 5, an embodiment of the wall system 15 is shown which includes at least one vertical column 31. In the present embodiment, the vertical column 31 is a steel column having a rectangular cross section. Referring to FIG. 3, the column 31 includes a lower end 32 having an opening 33. A bracket 34 having an upwardly extending leg 35 is mounted by a bolt 36 to the footer 12 adjacent the wall 10. The leg 35 has a width complemtnary with the width of the opening 33 of the column 31. As the column 31 is moved downwardly, as shown in FIG. 3, the opening 33 receives the leg 35 of the bracket 34 and holds the lower end 32 of the column 31 into position against the footer 12 and the wall 10.

Figure 4:
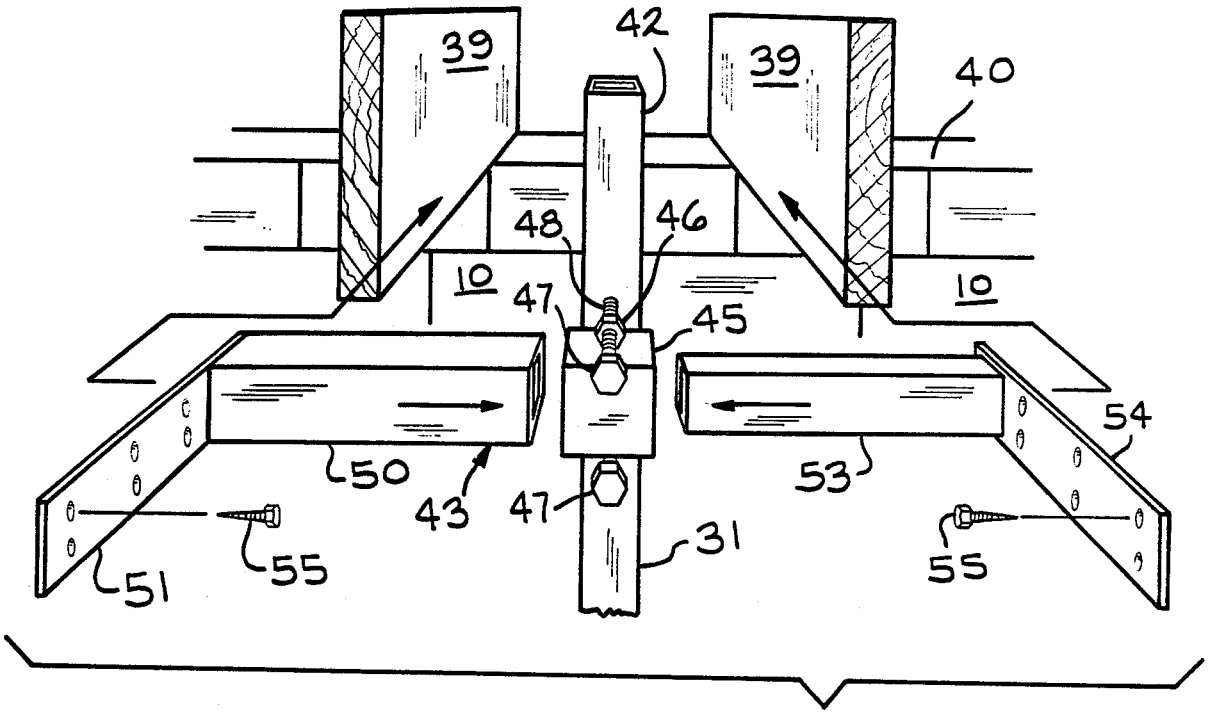
FIG. 4 is a fragmentary exploded view showing an embodiment of a wall system including a column and showing holding means adjacent the upper end of the column.

Referring to FIGS. 4 and 5, in the present embodiment floor joists 39 are spaced from one another and extend perpendicularly outwardly relative to the wall 10. The floor joists 39 are mounted on a top edge 40 of the wall 10. The vertical column 31 includes a top end 42 which extends between spaced ones of the floor joists 39 above the top edge 40 of the wall 10. Holding means, generally indicated by the reference number 43, are provided to hold the top end 42 of the column 31 adjacent the vertical wall 10. In the present embodiment the holding means 43 includes a rectangular sleeve 45 having a pair of nuts 46 welded to its opposed upper and lower outer surfaces. Bolts 47 extend through the nuts 46 and the through openings 48 provided in the top end 42 of the column 31 to tightly secure the rectangular sleeve 45 to the top end 42 of the column 31.

A first generally rectangular horizontal leg 50 has a plate 51 at its outer end and is received by the sleeve 45. A second leg 53 has a rectangular shape complementary with the first leg 50 and telescopes inside the first leg 50. The second telescoping leg 53 has a plate 54 connected to its outer end. The plates 51 and 54 are connected by screws 55 or other fasteners to spaced ones of the floor joists 39 as indicated in FIG. 4 and shown in its assembled position in FIG. 5. The portions of the collection member 17 which engage the lower end 32 of the vertical column 31 are sealed to maintain the water collection chamber 22 separate from the basement space. The wall system vertical column 31 applies a resisting force against the vertical wall 10 to support the wall 10 against exterior forces, such as exterior hydraulic forces.

Figure 6:
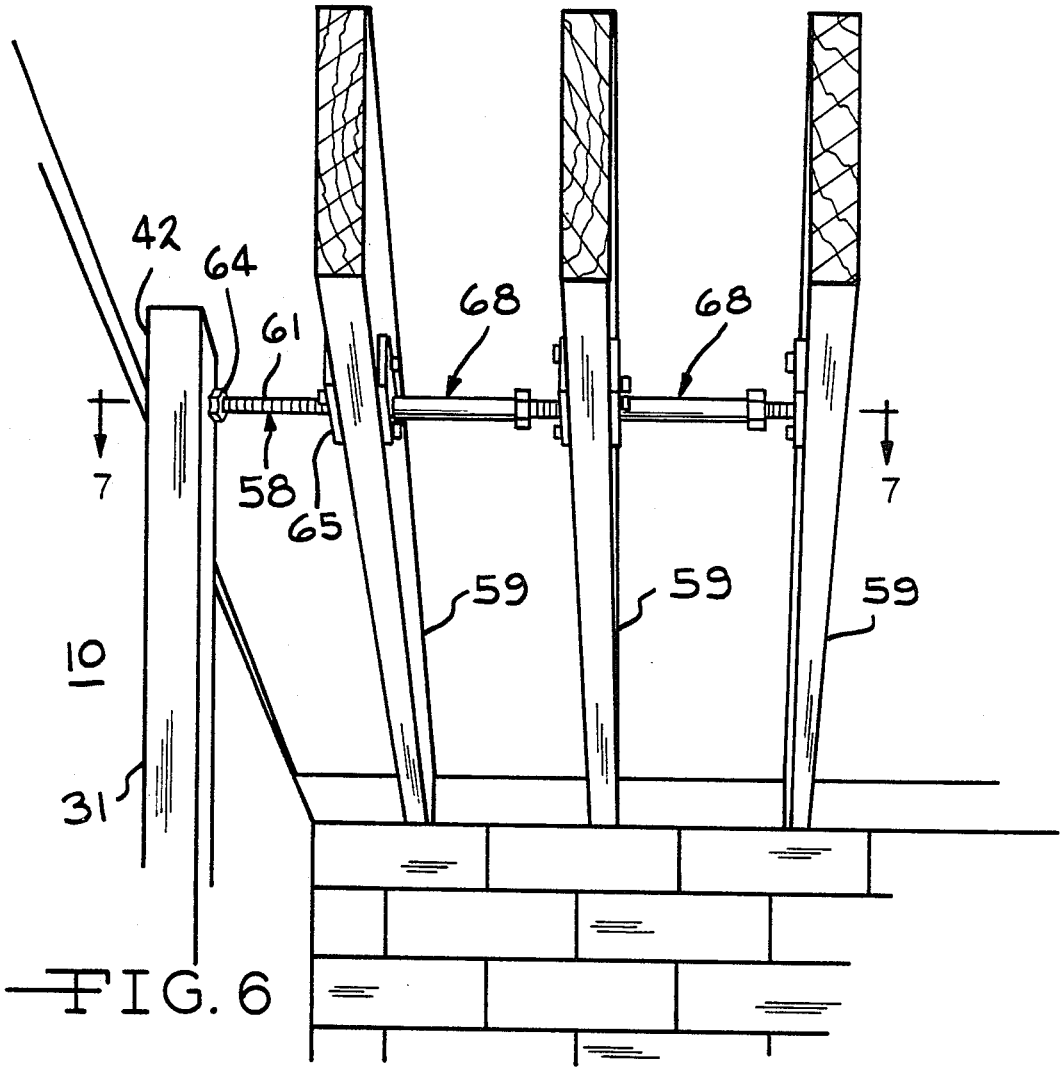
FIG. 6 is a perspective view of another embodiment of a wall system, according to the present invention including a column and showing holding means for the upper end of the column for use when floor joists run parallel to the wall.
Figure 7:
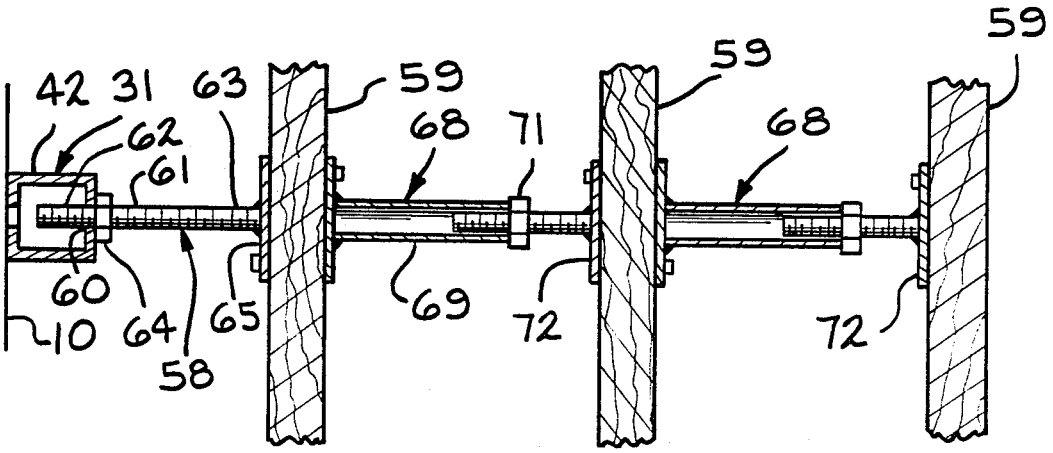
FIG. 7 is a fragmentary, sectional view taken along the line 7—7 of FIG. 6.

Referring to FIGS. 6 and 7, another embodiment of the wall system, according to the present invention, is shown including holding means generally indicated by the reference number 58. The holding means 58 are utilized when floor joists 59 are spaced parallel to the vertical wall 10. The holding means 58 includes an opening 60 defined in the upper end 42 of the column 31. A horizontal threaded shaft 61 has a first end 62 and a second end 63. The first end 62 of the shaft 61 is received in the opening 60 defined by the upper end 42 of the column 31. A nut 64 is mounted on the shaft 61 and positioned adjacent the top end 42 of the column 31. A pedestal 65 is mounted on the second end 63 of the shaft 61 and is attached to the floor joist 59 spaced from the vertical wall 10. The holding means 58 applies a resisting force on the wall 10, when such wall is subjected to exterior pressure.

In the embodiment shown in FIGS. 6 and 7, the holding means 58 also includes adjustable post assemblies 68 which are positioned between adjacent spaced ones of the floor joists 59 in general axial alignment with the horizontal threaded shaft 61. The adjustable post assembly 68 includes tube member 69 mounted at one end on one of the joists 59 and a horizontal threaded shaft 70. The threaded shaft 70 is received in the tube member 69 and a nut 71 is mounted on the threaded shaft 70 and is positioned against the end of the tube member 69. A pedestal 72 is mounted on the other end of the threaded shaft 70 and is attached to a spaced one of the floor joists 59. The additional adjustable post assemblies 69 when aligned with the threaded shaft assembly 61 provide additional resisting forces at the upper end 42 of the column 31.

Many modifications may be made to the embodiments described herein without departing from the scope of the following claims.

What I claim:

1. A wall system for use on a vertical longitudinally extending wall, the wall extending upwardly from a footer, a floor extending from said wall above said footer, said floor having an upper surface, said wall system comprising a drain conduit positioned beneath said floor adjacent said footer and extending generally parallel to such wall, a longitudinally extending collection member mounted on such wall adjacent such footer, said collection member having a top portion, a body portion and a lower edge portion, said top portion being attached to such wall and the lower edge portion positioned adjacent such footer, said body portion being spaced from such wall defining a water collection chamber with such wall, a plurality of vent holes defined by said body portion of said collection member, and a plurality of connector conduits positioned below said floor surface extending between the said body portion of said collection member and said drain conduit to remove water from such water collection chamber and transfering it to said drain conduit.

2. A wall system according to claim 1, wherein said lower edge portion of said collection member includes a turned-in leg positioned adjacent such footer.

3. A wall system according to claim 1, including at least one vertical support column for mounting adjacent such wall, such column extending upwardly from such footer.

4. A wall system according to claim 3, wherein said column defines an opening at its lower end and a bracket for attachment adjacent the lower portion of such wall, said bracket having an upwardly extending leg receiving such column opening.

5. A wall system for use on a vertical longitudinally extending wall, the wall extending upwardly from a footer, wherein floor joists are spaced at the top of the wall, said wall system comprising a drain conduit positioned adjacent said footer and extending generally parallel to such wall, a longitudinally extending collection member mounted on such wall adjacent such footer, said collection member having a top portion, a body portion and a lower edge portion, said top portion being attached to such wall and the lower edge portion positioned adjacent such footer, said body portion being spaced from such wall defining a water collection chamber with such wall, a plurality of connector conduits extending between the said body portion of said collection member and said drain conduit to remove water from such water collection chamber and transfering it to said drain conduit, and at least one vertical support column for mounting adjacent such wall, such column extending upwardly from such footer including holding means for holding the top end of said column adjacent the wall.

6. A wall system according to claim 5, wherein such floor joists are spaced parallel to such vertical wall and said holding means comprises an opening defined in the upper end of said column, a horizontal threaded shaft having first and second ends, said first end received within such opening, a pedestal mounted on said second end for positioning against one of said joists and a threaded member on said shaft adjacent said column.

7. A wall system according to claim 6, including at least one horizontal adjustable post assembly for positioning between adjacent ones of such floor joists in general axial alignment with said horizontal threaded shaft.

8. A wall system according to claim 5, wherein such floor joists are spaced perpendicular to such wall with the top end of said column positioned between two spaced floor joists and wherein said holding means comprises a sleeve attached adjacent the top end of said column, a pair of horizontal telescoping legs received by said sleeve and mounting plates connected to the outer ends of said telescoping legs, said plates being connectable to spaced ones of such floor joists.

* * * * *